US007533786B2

(12) United States Patent
Woolfson et al.

(10) Patent No.: US 7,533,786 B2
(45) Date of Patent: May 19, 2009

(54) PERSONAL WATER AND ADDITIVE APPARATUS

(75) Inventors: Steven Woolfson, Boston, MA (US); Matthew Kressy, Wellesley, MA (US); Reed Hoyt, Framingham, MA (US); Scott Montain, Holliston, MA (US)

(73) Assignee: The United States of America as represented by the Secretary of the Army, Washington, DC (US)

( * ) Notice: Subject to any disclaimer, the term of this patent is extended or adjusted under 35 U.S.C. 154(b) by 277 days.

(21) Appl. No.: 10/875,020

(22) Filed: Jun. 23, 2004

(65) Prior Publication Data

US 2004/0262331 A1 Dec. 30, 2004

Related U.S. Application Data

(60) Provisional application No. 60/483,465, filed on Jun. 30, 2003.

(51) Int. Cl.
*B67D 5/60* (2006.01)
*B67D 1/08* (2006.01)

(52) U.S. Cl. ..... 222/144.5; 222/145.7; 222/175; 222/145.5; 224/148.2

(58) Field of Classification Search ..... 222/145.1, 222/145.3, 145.5, 145.6, 145.7, 145.8, 94, 222/129, 175, 572, 529, 475, 527; 220/714; 224/148.1, 148.2, 148.4; 239/33
See application file for complete search history.

(56) References Cited

U.S. PATENT DOCUMENTS 1,707,058 A 3/1929 Kauwertz
3,348,737 A * 10/1967 Yingst et al. ..... 222/58
3,411,534 A * 11/1968 Rose ..... 137/595
3,463,361 A 8/1969 Cook et al.
4,681,244 A * 7/1987 Geddie ..... 222/144.5
4,692,144 A 9/1987 Carpenter
4,815,635 A 3/1989 Porter
4,821,895 A 4/1989 Roskilly
5,188,019 A * 2/1993 Vahabpour ..... 99/285
5,188,090 A * 2/1993 Griggs ..... 126/247
5,249,702 A 10/1993 Topp et al.

(Continued)

FOREIGN PATENT DOCUMENTS

AU 534984 2/1984

(Continued)

*Primary Examiner*—Kevin P Shaver
*Assistant Examiner*—Stephanie E Tyler
(74) *Attorney, Agent, or Firm*—Elizabeth Arwine; Marcus A. Streips

(57) ABSTRACT

A personal water and additive apparatus includes a first container; a manifold having a water passageway and an additive passageway, the water passageway and additive passageway intersecting to form a single mixing passageway; a first tube connecting the first container to the water passageway of the manifold, the combination of the first tube and the water passageway defining a water channel; a second container; a second tube connecting the second container to the additive passageway of the manifold, the combination of the second tube and the additive passageway defining an additive channel; an outlet tube having one end connected to the mixing passageway of the manifold; a check valve disposed in the water channel; and a flow regulator that controls flow in at least one of the water passageway and the additive passageway.

17 Claims, 4 Drawing Sheets

U.S. PATENT DOCUMENTS

| | | | | |
|---|---|---|---|---|
| 5,593,091 | A | 1/1997 | Harris | |
| 6,032,873 | A * | 3/2000 | Weinstein | 239/33 |
| 6,503,222 | B2 | 1/2003 | Lo | |
| 6,749,090 | B2 * | 6/2004 | Bailey | 222/175 |
| 2003/0075573 | A1 | 4/2003 | Bailey | |
| 2004/0118942 | A1 | 6/2004 | Courtney | |

FOREIGN PATENT DOCUMENTS

| | | |
|---|---|---|
| DE | 3101490 | 8/1982 |
| DE | 29606710 | 6/1996 |
| DE | 20014733 | 10/2000 |
| GB | 2116058 | 9/1983 |
| GB | 2249775 | 5/1992 |
| WO | WO 03/035537 | 5/2003 |

* cited by examiner

PERSONAL WATER AND ADDITIVE APPARATUS

CROSS-REFERENCE TO RELATED APPLICATIONS

This application claims the benefit of priority from U.S. provisional patent application Ser. No. 60/483,465 filed Jun. 30, 2003, which is hereby incorporated by reference.

STATEMENT OF GOVERNMENT INTEREST

The invention described herein may be manufactured and used by or for the Government of the United States of America for government purposes without the payment of any royalties therefor.

BACKGROUND OF THE INVENTION

The invention relates in general to personal hydration devices and in particular to personal hydration devices that provide for the addition of substances into the personal water supply of an individual.

Water is essential for good health. Individuals undergoing physical exertion, in particular soldiers, athletes and the physically active members of the public, have increased water consumption needs and thus often require a personal hydration device to maintain the necessary level of hydration. In addition, it can be advantageous to introduce other substances into the drinking water for purposes such as taste enhancement, electrolyte or essential salt replacement, nutritional support, etc.

There may be several obstacles to sustaining hydration, electrolyte balance and energy status. For example, chlorinated or iodinated water commonly does not taste good thereby inhibiting water consumption. Attempting to improve electrolyte balance by simply adding sodium to chlorinated water, without flavoring, brings out the unpleasant taste of chlorine. The taste of water can be improved by adding flavorings, but flavorings almost instantly destroy residual chlorine and compromise resistance to contamination. The food intake of soldiers and other physically active people in the field is often inadequate. For example, soldiers in the field typically consume an inadequate amount of carbohydrate. However, simply adding carbohydrate to water increases the risk of mold and bacterial growth inside a personal bladder-type water reservoir. The bacterial contamination of water can cause diarrhea.

Some known devices for personal hydration with additives require a separate drink container, for example, a canteen cup, to mix the drink ingredients. In other devices, the additive is added directly to the water reservoir, thereby contaminating the water reservoir and/or compromising water resistance to contamination.

In the present invention, a separate drink container is not required for mixing the additive with the water. In addition, the user is not required to physically add water to the additive or vice versa before consumption. Furthermore, the present invention does not contaminate the water reservoir or compromise water resistance to contamination.

Typical personal bladder-type hydration systems comprise a water reservoir with a tube leading to a bite valve. The present invention improves on prior systems by allowing additives to be mixed with water just prior to being drawn through the bite valve into the user's mouth. Also, a check valve prevents contamination of the water in the reservoir. Thus, the invention provides additives to water in a manner that does not contaminate the water reservoir or compromise water resistance to contamination.

The invention enables the user to consume the nutrients or additives necessary for the chosen activity. The additives may include flavoring, macronutrients (i.e., carbohydrate, protein, fat), micronutrients (e.g., electrolytes, minerals, vitamins), aspirates, oral medications or other dietary supplements. In addition, the primary fluid may be something other than water, for example, a beverage.

Further objects, features and advantages of the invention will become apparent from the following detailed description taken in conjunction with the following drawing.

BRIEF DESCRIPTION OF THE DRAWINGS

Throughout the Figures, reference numerals that are the same refer to the same features.

DETAILED DESCRIPTION OF THE PREFERRED EMBODIMENTS

An important purpose of the invention is to introduce an additive into a personal water supply in such a way as to prevent contamination of the water reservoir by the additive. The invention enables the user to consume the additives necessary for their chosen activity while maintaining a reservoir supply of uncontaminated water. The composition of the additives is highly versatile and may include those specific to exercise such as electrolytes, flavoring, carbohydrates, vitamins, etc. Additionally, the device may be used to administer oral medications or dietary supplements. The additives may be in solid form, for example, granules or tablets, or in liquid or gel form.

Figure 1:
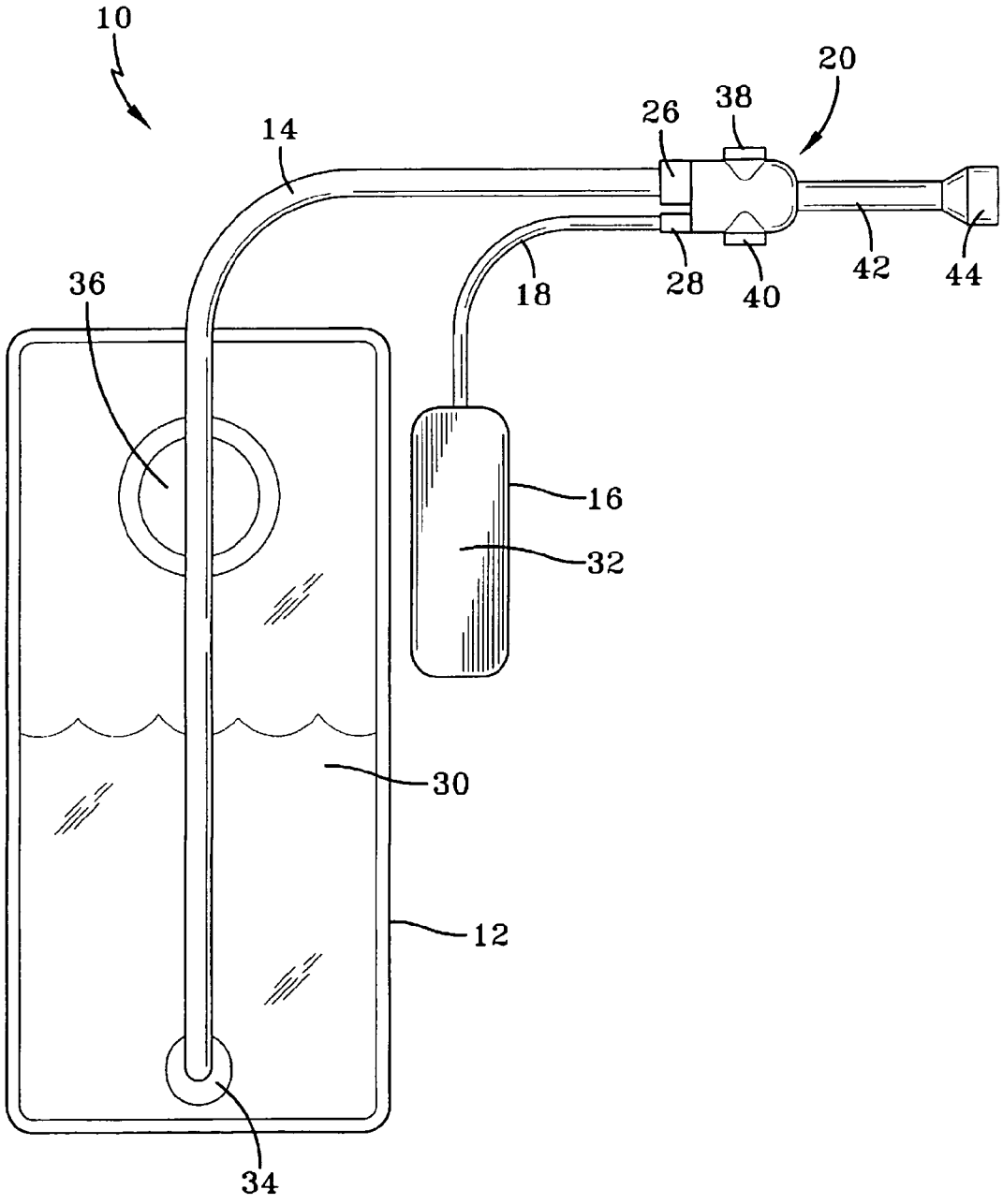
FIG. 1 is a schematic view of one embodiment of the invention.
Figure 2:
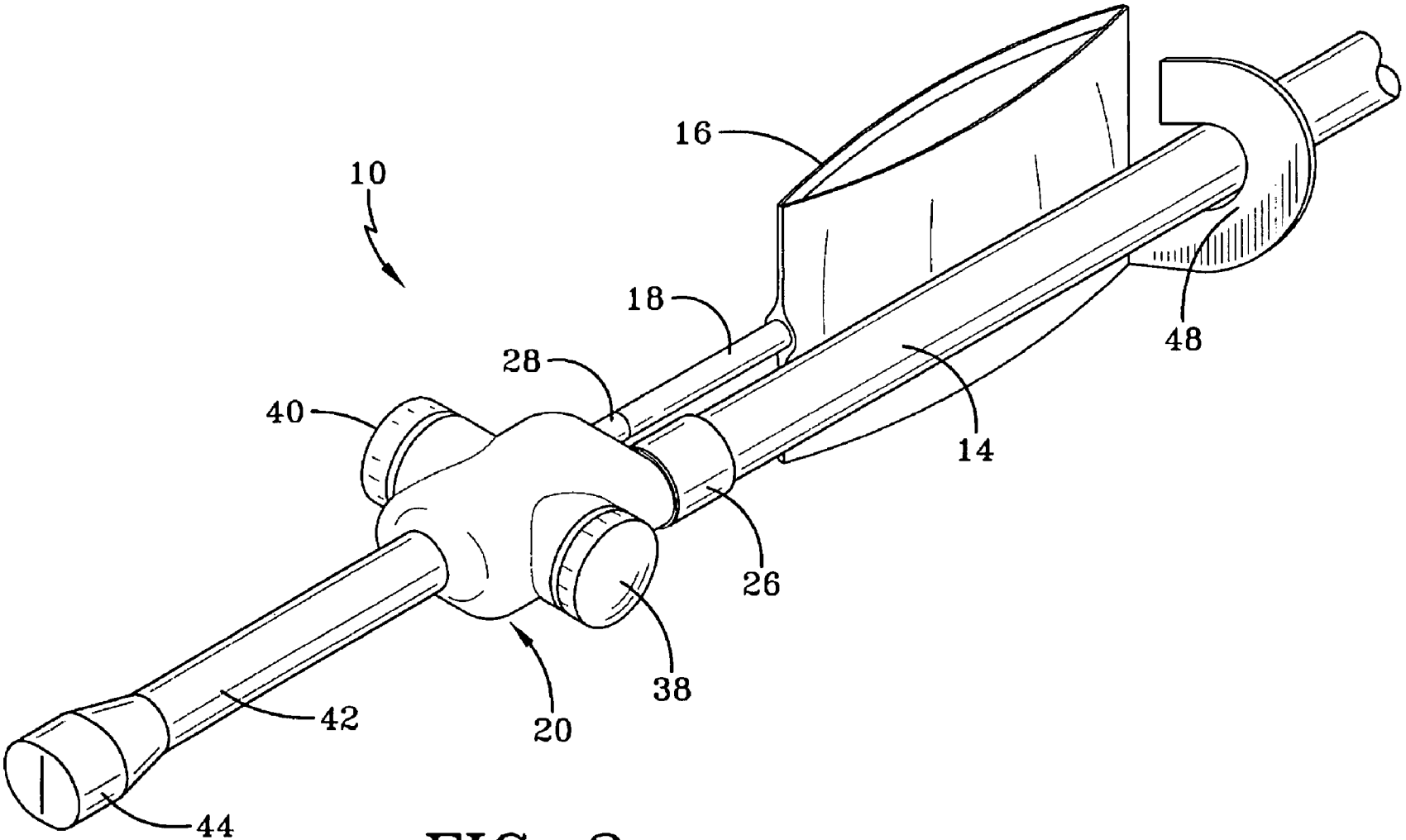
FIG. 2 is a partial perspective view of the embodiment of FIG. 1.
Figure 3:
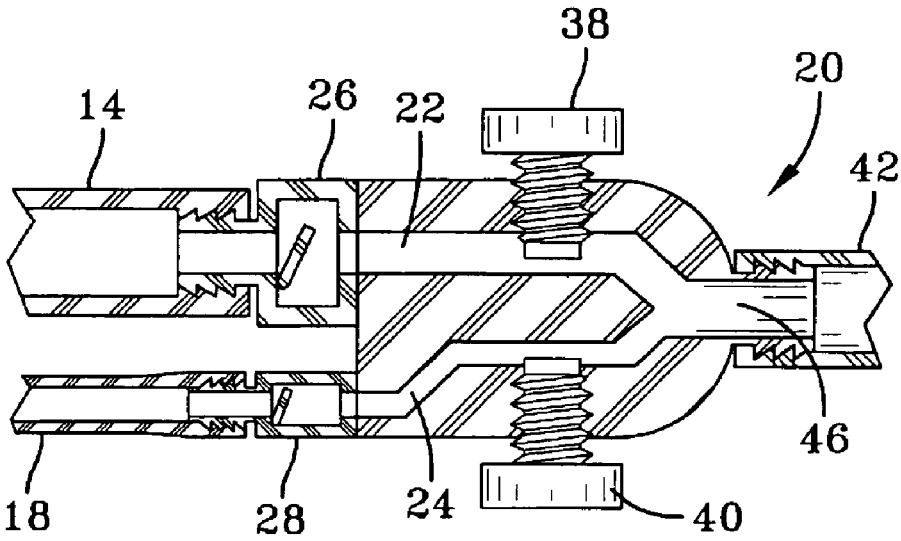
FIG. 3 is a sectional view of the manifold of the embodiment of FIG. 1.

FIG. 1 is a schematic view of one embodiment of a personal water and additive apparatus 10 according to the invention. FIG. 2 is partial perspective view of the embodiment of FIG. 1. In FIG. 2, the water container 12 is not shown. FIG. 3 is a sectional view of the manifold 20 of the embodiment of FIG. 1.

Referring now to FIGS. 1-3, apparatus 10 includes a first container 12 connected to a manifold 20 by a first tube 14. Container 12 is capable of holding liquid and includes a fill opening 36 and an outlet 34. Preferably, container 12 is of the collapsible bladder type. Container 12 is filled with water 30. Second container 16 is connected to manifold 20 by a second tube 18. Container 16 is capable of holding liquid and preferably is a collapsible bladder type container. Container 16 is filled with additive 32 that will be mixed with water 30 from container 12. Second container 16 has a volume smaller than the first container 12, preferably less than half the volume of the first container 12.

As shown in detail in FIG. 3, manifold 20 includes a water passageway 22 and an additive passageway 24. The water passageway 22 and additive passageway 24 intersect to form a single mixing passageway 46. In some embodiments, the water passageway 22 has a larger diameter than the additive passageway 24. In the embodiment of FIG. 3, however, the relative sizes of the diameters of the water passageway 22 and additive passageway 24 are not critical because flow regulator 38, 40 controls the flow rate in passageways 22, 24 respectively and thereby create the desired proportions of water 30 and additive 32. The first tube 14 connects the first container 12 to the water passageway 22 of the manifold and the second tube 18 connects the second container 16 to the additive passageway 24. The combination of the first tube 14 and water passageway 22 define a water channel and the combination of the second tube 18 and the additive passageway 24 define an additive channel. An outlet tube 42 has one end connected to the mixing passageway 46 of the manifold. The other end of outlet tube 42 may optionally be connected to a bite valve 44.

A check valve 26 is disposed in the water channel, preferably adjacent the manifold 20. Check valve 26 prevents reflux of water and/or water and additive mixture into the first tube 14 and the water 30 in container 12. Similarly, a check valve 28 is disposed in the additive channel, preferably adjacent the manifold 20, to prevent reflux into the additive container 16.

An adjustable flow regulator 38, 40 controls flow in the water passageway 22 and the additive passageway 24. In the embodiment of FIG. 3, adjustable flow regulator 38, 40 comprises a pair of independently operated threaded valves that can be rotated to fully open (full flow) or completely block (no flow) the water and additive passageways 22, 24. In addition, the adjustable flow regulator 38, 40 is infinitely adjustable between full flow and no flow. Another embodiment of a flow regulator (not shown) comprises a single spool valve or similar type valve to control flow through the two passageways 22, 24. In this embodiment, pushing in the valve would open the water passageway only, a further push would open both the water and additive passageways.

Additive 32 in container 16 may be a liquid, solid or gel. An exemplary, but not exhaustive, list of additives includes a beverage, a beverage concentrate, electrolytes, flavorings, carbohydrates, vitamins, aspirates, medications and dietary supplements. In the embodiment shown in FIG. 2, the additive container 16 is attached to the first tube 14 by a hook connector 48 extending from the base of container 16. Additive container 16 may be located further from manifold 20 by extending the tube 18.

It is contemplated that additive container 16 will not be reused. That is, a plurality of additive containers 16 containing different additives are available and can be connected to and disconnected from the apparatus 10, depending on the additive that is needed. When the additive 32 is depleted, or it is desired to use another additive, the additive container 16 is detached and another additive container is attached. In one embodiment, the tube 18 is removably connected to the additive container 16. Such removable connections are known in the art and include, for example, barb connections, screw on connections (e.g., Leur lock, threaded) or connectors that use push-on type connections. In another embodiment, the tube 18 is permanently connected to additive container 16 and removably connected to manifold 20. With the exception of water 30 and additive 32, all the components of apparatus 10 may be made of known plastic materials.

To use apparatus 10, an individual sucks on the optional bite valve 44 to draw water 30 and additive 32 into mixing passageway 46 and outlet tube 42. In the embodiment of FIGS. 1-3, flow through either the water passageway 22 or additive passageway 24 is controlled by adjustable flow regulator 38, 40. When both passageways 22, 24 are open, the act of sucking on the bite valve 44 simultaneously draws fluid from both containers 12, 16. Assuming additive 32 is a flavoring, then a flavored drink is automatically produced when the additive 32 and water 30 mix in the mixing passageway 46 of the manifold 20. The resulting drink mix travels through the outlet tube 42 and the bite valve 44. The concentration of additive 32 in the drink mix may be altered by adjusting flow regulator 38, 40.

The connectors used to fix tubes 14, 18 to manifold 20 are shown in the Figs. as barb connectors, however, other connectors may be used, such as connectors that screw on (e.g., Luer lock, threaded) or connectors that use push-on type connections.

Figure 4:
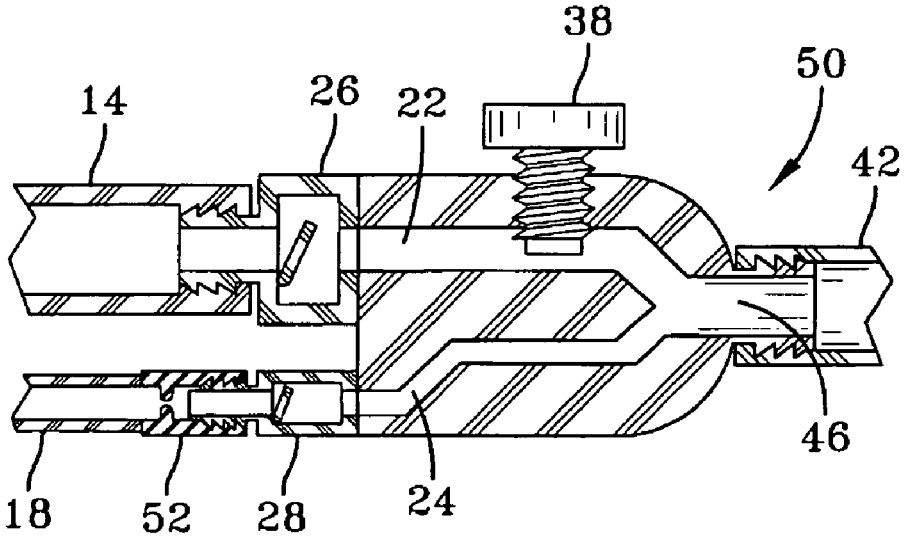
FIG. 4 is a sectional view of a second embodiment of a manifold.
Figure 5:
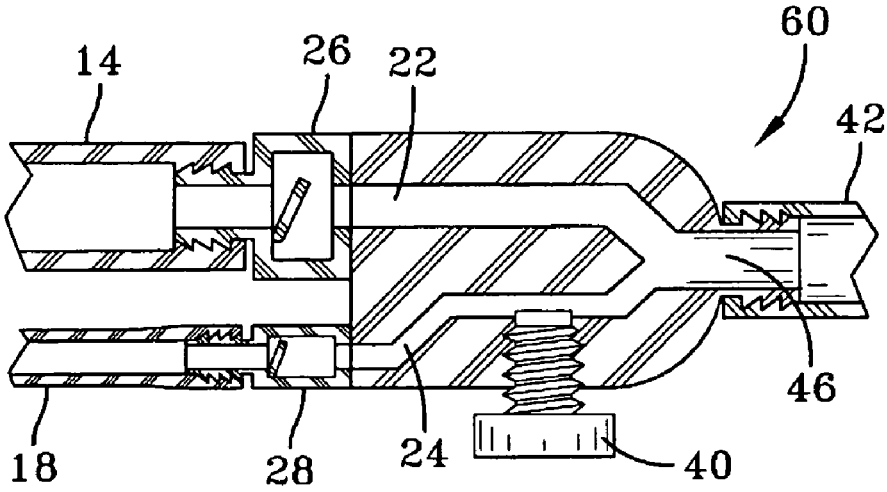
FIG. 5 is a sectional view of a third embodiment of a manifold.
Figure 6:
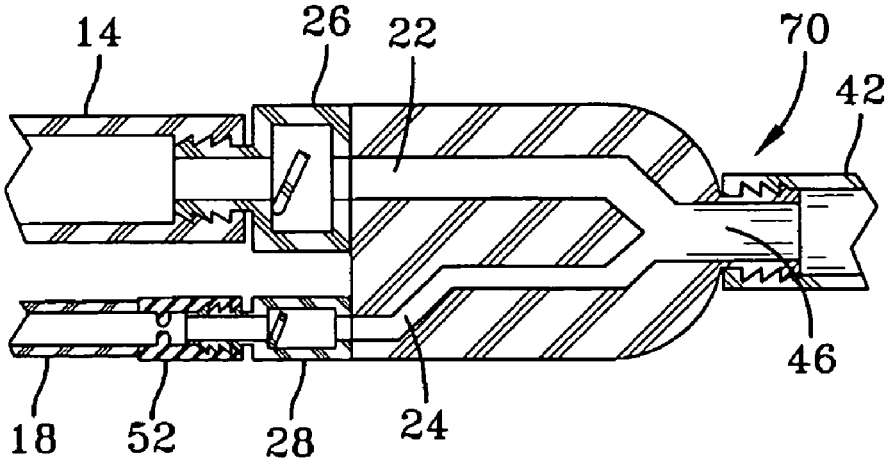
FIG. 6 is a sectional view of a fourth embodiment of a manifold.

FIGS. 4-6 are sectional views of second, third and fourth embodiments of a manifold. FIG. 4 shows a manifold 50 that is different from manifold 20 in two ways. First, flow regulator 40 has been deleted and second, a restrictive orifice 52 has been added in the additive channel, preferably adjacent the manifold 50. Orifice 52 functions as a nonadjustable flow regulator for the additive channel. Different sized orifices 52 may be used, depending on the viscosity and the amount of additive desired to be mixed with water 30.

FIG. 5 shows a manifold 60 that is identical to manifold 20 except that flow regulator 38 has been deleted. The proportion of additive 32 to water 30 is controlled by flow regulator 40 in the additive passageway 24. FIG. 6 shows a manifold 70 that is similar to manifold 50 of FIG. 4 except that flow regulator 38 has been deleted. Flow regulation in manifold 70 is accomplished by a restrictive orifice 52 in the additive channel, the orifice 52 preferably being located adjacent the manifold 70.

In the embodiment of FIG. 6, the ratio of additive 32 to water 30 is dictated by the volumetric flow rate through each passageway 22, 24. The flow rates are dependent upon the fluid viscosity of the water 30 and additive 32 and the fluidic resistance of passageways 22, 24; tubes 14, 18; check valves 26, 28; and restrictive orifice 52. Because the flow rates in manifold 70 are fixed for a given additive 32, manifold 70 has the advantage of maintaining a fixed concentration of additive to water for a given assembly. On the other hand, it is contemplated that the user may desire to change from a low viscosity additive (such as an electrolyte) to a higher viscosity additive (such as a carbohydrate) and mix the new additive with water at a different ratio. In such a case, a different size restrictive orifice may be used in combination with the new additive to create the fluidic resistance necessary to obtain the desired concentration of the new additive to water.

While the invention has been described with reference to certain preferred embodiments, numerous changes, alterations and modifications to the described embodiments are possible without departing from the spirit and scope of the invention, as defined in the appended claims and equivalents thereof.

What is claimed is:

1. A personal water and additive apparatus, comprising:

a non-pressurized first container capable of holding liquid;

a manifold having a water passageway and an additive passageway, the water passageway and additive passageway intersecting to form a single mixing passageway;

a first tube connecting the first container to the water passageway of the manifold, the combination of the first tube and the water passageway defining a water channel;

a non-pressurized second container capable of holding liquid, the second container having a volume less than half a volume of the first container;

a second tube connecting the second container to the additive passageway of the manifold, the combination of the second tube and the additive passageway defining an additive channel;

an outlet tube having one end connected to the mixing passageway of the manifold;

a check valve disposed in the water channel; and a flow regulator that controls flow in at least one of the water passageway and the additive passageway, wherein the flow regulator is an adjustable flow regulator that is adjustable to allow full flow, partial flow and no flow through the at least one of the water passageway and the additive passageway.

2. The apparatus of claim 1 wherein the adjustable flow regulator controls flow in only the water passageway.

3. The apparatus of claim 1 wherein the adjustable flow regulator controls flow in only the additive passageway.

4. The apparatus of claim 1 wherein the adjustable flow regulator controls flow in both the water passageway and the additive passageway.

5. The apparatus of claim 1 wherein the adjustable flow regulator is infinitely adjustable between full flow and no flow.

6. The apparatus of claim 1 wherein the first container comprises a collapsible bladder.

7. The apparatus of claim 1 wherein the second container comprises a collapsible bladder that is not reused.

8. The apparatus of claim 1 further comprising a beverage in the first container.

9. The apparatus of claim 1 wherein the water passageway has a larger diameter than the additive passageway.

10. The apparatus of claim 1 further comprising an additive disposed in the second container, the additive comprising at least one of a liquid, solid and gel.

11. The apparatus of claim 10 wherein the additive comprises at least one of a beverage, a beverage concentrate, flavoring, macronutrients, micronutrients, oral medications, aspirates, and dietary supplements.

12. The apparatus of claim 1 further comprising a restrictive orifice disposed in the additive channel.

13. The apparatus of claim 1 further comprising a second check valve disposed in the additive channel.

14. The apparatus of claim 1 further comprising a bite valve attached to another end of the outlet tube.

15. A method, comprising:

providing the personal water and additive apparatus of claim 1;

placing water in the first container and a beverage concentrate in the second container;

sucking on the outlet tube to cause the water and the beverage concentrate to mix in the mixing passageway to produce a beverage.

16. The method of claim 15 further comprising adjusting the flow regulator to allow partial flow in the additive passageway.

17. The method of claim 15, wherein placing a beverage concentrate in the second container is performed only once.

* * * * *